US008307578B1

(12) United States Patent
Azhocar

(10) Patent No.: US 8,307,578 B1
(45) Date of Patent: Nov. 13, 2012

(54) GUN MAGAZINE-CLIP FINGER-TIP SUPPLEMENTAL-RELEASE TOOL

(76) Inventor: Frederick S. Azhocar, San Diego, CA (US)

( * ) Notice: Subject to any disclaimer, the term of this patent is extended or adjusted under 35 U.S.C. 154(b) by 193 days.

(21) Appl. No.: 12/462,677

(22) Filed: Nov. 12, 2009

(51) Int. Cl.
*F41C 27/00* (2006.01)

(52) U.S. Cl. ..... 42/108; 42/6

(58) Field of Classification Search ..... 42/6, 7, 42/49.01, 108; 200/341, 344, 345
See application file for complete search history.

(56) References Cited

U.S. PATENT DOCUMENTS

| | | | | |
|---|---|---|---|---|
| 970,264 | A | 9/1910 | Peterson | |
| 2,151,846 | A | 3/1934 | Greneker | |
| 2,509,837 | A * | 5/1950 | Niizawa | 401/7 |
| 2,735,321 | A | 2/1956 | Browne | |
| 2,895,139 | A | 7/1959 | Compton | |
| 3,333,850 | A | 8/1967 | Miller | |
| 3,746,815 | A | 7/1973 | Drummer | |
| 3,968,585 | A | 7/1976 | Linha | 43/4 |
| 4,084,824 | A | 4/1978 | Kalivas | 274/1 R |
| 4,177,698 | A | 12/1979 | Greneker | 81/1 R |
| 4,334,492 | A | 6/1982 | Klingler | |
| 4,466,313 | A | 8/1984 | Gardner | 81/3.46 R |
| 4,521,985 | A * | 6/1985 | Smith et al. | 42/7 |
| 4,771,144 | A * | 9/1988 | Goyarts | 200/306 |
| D301,963 | S * | 7/1989 | Jackson | D8/14 |
| D303,915 | S * | 10/1989 | Knutson | D8/18 |
| 4,919,016 | A * | 4/1990 | Hanegraaf | 81/3.55 |
| 5,070,563 | A | 12/1991 | Tervola | 7/169 |
| 5,182,972 | A | 2/1993 | Skaleski | 81/44 |
| 5,234,142 | A | 8/1993 | Loewen | 223/101 |
| 5,519,954 | A | 5/1996 | Garrett | 42/6 |
| 5,916,340 | A * | 6/1999 | Forsyth | 81/125 |
| 6,173,519 | B1 * | 1/2001 | Garrett | 42/90 |
| 6,300,582 | B1 | 10/2001 | Huang | |
| 6,546,596 | B2 | 4/2003 | Grote et al. | |
| D488,588 | S * | 4/2004 | Murphy | D29/114 |
| 6,867,680 | B1 * | 3/2005 | Kulle | 338/32 H |
| 6,913,406 | B1 | 7/2005 | Nocerino | 401/7 |

(Continued)

FOREIGN PATENT DOCUMENTS

FR 2620563 A1 3/1989

(Continued)

*Primary Examiner* — Bret Hayes
*Assistant Examiner* — Joshua Freeman
(74) *Attorney, Agent, or Firm* — Knobbe, Martens, Olson & Bear, LLP

(57) ABSTRACT

A handy time-saving finger-tip device facilitating more convenient release of an magazine-clip from a gun such as an AR-15 rifle, some of which magazine/release-buttons are configured with a statute-mandated recessed sub-button therein, heretofore requiring dexterous insertion of a separate pocket-carried cylindrical probe-tool. The notion hereof being to supplement actuation of the present awkwardly operating release-button, with a more convenient and reliable release device referred to as the MagMagnet™, which I set forth herein in two iterations. The first embodiment preferably being an index-finger stall adapted with an insertion-pin; while my second embodiment is a self-retaining version, which attaches directly into the existing magazine/release sub-button instead of being retained upon the shooter's index-finger. Both iterations serving the common purpose of enabling the gun user at a firing-range to more efficiently dispatch the spent magazine-clip for a loaded one, in a safer and substantially more efficient time-&-motion manner, whereby the target-shooter is enabled to more safely maintain their attention down-range, without the distraction of fumbling for a possibly misplaced probe-tool by which to actuate the mandated BulletButton®.

10 Claims, 2 Drawing Sheets

U.S. PATENT DOCUMENTS

| | | | | |
|---|---|---|---|---|
| 7,357,225 | B2 * | 4/2008 | Dorian | 184/1.5 |
| 7,393,342 | B2 | 7/2008 | Henniges et al. | |
| 8,011,277 | B2 * | 9/2011 | Johnson et al. | 81/177.4 |
| 2004/0104080 | A1 * | 6/2004 | Sweet et al. | 187/395 |
| 2006/0123683 | A1 * | 6/2006 | Garrett et al. | 42/6 |
| 2010/0236911 | A1 * | 9/2010 | Wild et al. | 200/345 |
| 2011/0056107 | A1 | 3/2011 | Underwood | |

FOREIGN PATENT DOCUMENTS

| | | | |
|---|---|---|---|
| GB | 2239352 | A | 6/1991 |
| JP | 05250959 | A | 9/1993 |
| WO | WO 03097127 | A1 | 11/2003 |

* cited by examiner 12A
16
16S
15'
16A
13
14H
135
14"
14N
15
13"
13'
14L
15"
16
16P
14
14'
17
16'
10'
10A
17
16"
11"
12A
16"
16"
17
W
16M
16A
.10"
L
17"
17'
17
H
11"
11
10A
16'
.250"
17"
.063"
11'
.325"
17
16M
16"

GUN MAGAZINE-CLIP FINGER-TIP SUPPLEMENTAL-RELEASE TOOL

I.) BACKGROUND OF THE INVENTION

1. Field of Invention

This invention relates to semi-automatic firearms of the well known and popular M-16/AR-15 rifle type;—and more specifically this invention addresses the magazine-clip release-button mechanism of the type which has been modified by mandated-statute from automatic-operation (—formerly capable of repeated firing upon a single pull of the trigger),—and to further require insertion of a supplemental magazine-clip release tool intended to restrictively impede rapid-reloading.

2. Relevant Prior-Art

Background research discovery provides some prior patent-art regarded as germane to this disclosure, chronologically for example U.S. Pat. No. 2,151,846 (filed: November 1934) contemplates a thimble like finger stall of metal or other composition adapted with a probe like extension tip 18, some versions of which include screw-threads, and these tips are exemplified as implements such as a tiny paint-brush, a writing-pen, or a rigid tool. An encircling presumably elastic-band 15 serves to help stay the laterally-split 14 finger-stall portion 11 to the outermost portion of the index-finger. However, the finger-extension tips are all arranged coaxially with the longitudinal-axis of the user's finger-tip, and the stall is formed substantially around the user's finger, thereby intentionally preventing joint articulation of the outer finger region.

In U.S. Pat. No. 2,735,321 (filed: November 1952) is shown a C-shaped finger-tip tool, including integral provision of a hex-shaped wrenching surface;—affording convenient accessibility into otherwise impossible to reach places where a screw-threaded but must be held in place during assembly of some apparatus for example. However, the hex portion is an aperture, and therefore does not provide any sort of pin-like entity.

In U.S. Pat. No. 2,895,139 (filed: September 1954) is shown a hand-glove which underside is adapted with one or more rigid tapered spike-like piercing pins 30, which function as a scaling device during the cleaning processing of fish. The pins are supported upon stabilizing backing-plates sandwiched to the glove-material; and one of the pin iterations is shown with a non-tapering blunt-tip; however, it is formed such that its width is approximately twice that of its height, therefore it would be incapable of functioning in the manner required of my instant disclosure hereto.

In U.S. Pat. No. 3,333,850 (filed: July 1964) is shown a bowling-glove with four fingertip ball-aperture engaging pins;—however, none of the pins act to depress an internal-button as is done in my instant disclosure hereof.

In U.S. Pat. No. 3,968,585 (filed: March 1975) is shown a fisherman's thimble-like thumb-stall adapted with a fingernail like protrusion provided with at least one notch entity serving to positively engage the device upon the wirespring-clasp portion of an ordinary leader-snap;—however, owing to its wedge like formation and usage upon one's thumb, there is no adaptability of this implement which could anticipate my invention disclosure hereof.

In U.S. Pat. No. 4,084,824 (filed: August 1976) is shown a thimble-like thumb-stall adapted with a protruding nodule which inserts into the spindle-hole of an audio-disk record, whereby the user is enabled to grasp the record using their opposing fingers without touching the record's playing-surface. However, the thumb-stall is not ergonomically adaptable to usage as pertains to my instant disclosure hereof.

In U.S. Pat. No. 4,177,698 (filed: March 1978) is shown an index-finger stall for an artisan, wherein means is provided for insertion of interchangeable implements such as a paint-brush or cutting-blade; neither of which being suited to function in the manner of my instant disclosure hereof.

In U.S. Pat. No. 4,466,313 (filed: May 1983) is shown a finger-stall made of a rigid material formed with an oval loomen extension member which enables the tongue-like opener-tab of a beverage-can to be inserted for finger lifting without breaking one's fingernail. However, owing to the shape of the extension, there is no possibility of the device being used in the manner of my instant disclosure hereof.

In U.S. Pat. No. D301,963 (filed: April 1986) is shown a finger-tip stall said to be designed as a calculator button pusher; however, owing the non-cylindrical formation of the tip, there is no possibility of the device being used in the manner of my instant disclosure hereof.

In U.S. Pat. No. 5,070,563 (filed: February 1990) is shown a tool bearing finger-ring, wherein several different implements are radially affixed about the circumference of the ring, such as a screwdriver-tip, glass-cutter, and including a cylindrically shaped magnet of utilitarian convenience. However, owing that the ring is free to swivel around the longitudinal-axis of one's finger, there is no practical implementation of this ring in the manner of my instant disclosure hereof.

In U.S. Pat. No. 5,182,972 (filed: March 1991) is shown a band like finger-stall of resilient plastic wherein is included a hole provided with radial-slits for the holding of a screw-threaded shank, and thereby facilitating easier access relative to a confined assembly procedure. However, owing that a screw-shank is only lightly gripped therein, there would be no practical implementation as a release-pin in the manner of my instant disclosure hereof.

In U.S. Pat. No. 5,234,142 (FILED: September 1992) is shown a rigid finger-stall having a resilient urethane-foam type internal-liner 23 which aids in the universal fitting of the device to one's finger-tip. This invention serves to protect one's finger-tips from hammer blows, and includes support for a longitudinal cutting-blade, as well as teeth which serve to aid the user in gripping things. However, there is no possible implementation as a release-pin in the manner of my instant disclosure hereof.

In U.S. Pat. No. 5,519,954 (filed: June 1995) is shown an ambidextrous ammo.-magazine release mechanism for an AR-15 type rifle; this patent setting forth a special ammunition magazine-clip release button which can be readily operated from either the left or right sides of the breech-body. However, the magazine-clip release-mechanism is for both fully-automatic as well as semi-automatic versions, but not for the statute-mandated type of release-button having an integral sub-button therein. Accordingly, this patent is referenced primarily as a matter of interest, in that it also addresses function of the OEM (Orig. Equip. Mfg.) Ar-15 rifle's ammo.-magazine release-button 44 (see FIGS. 6/7/8), albeit not of the modified so called BulletButton® of California.

In U.S. Pat. No. 6,913,406 (filed: March 2004) is shown a finger-tip stall providing an integral ballpoint-pen, which alleviates an arthriticly-impaired writer from having to otherwise grip the body of a conventional pen; and employs use of a laterally-adjustable velcro-strap 4A by which to secure intimate fitting of the stall's body 1A about the user's outermost finger region beyond the 3rd-knuckle of a finger). However, owing the objective of the device as a writing-instrument, the leading longitudinal portion of the finger-stall is therefore necessarily extended by an ink-reservoir (cartridge)

1D, which measures about 2 mm-long×almost 1 mm-diam., which would make usage of this device impossibly awkward if dangerously cumbersome relative to any endeavored usage in the manner of my instant invention disclosure hereof.

Therefore, in full consideration of the preceding prior-art patent-search review, there is determined a need for an improved form of device to which these patents have been largely addressed. The instant inventor hereof believes their newly improved ammunition magazine-clip release implement, commercially referred to as the MagMagnet™, currently being developed for production under auspices of the TriggerFinger™ Mfg./Mkt. Co., exhibits certain advantages as shall be revealed in the subsequent portion of this instant disclosure.

II.) SUMMARY OF THE INVENTION

A.) In view of the foregoing discussion about the earlier invention art, it is therefore important to make it pellucid to others interested in the art, that the object of this invention is to provide a supplemental rifle ammunition magazine-clip button-depressor means by which to facilitate a more efficient time-&-motion operation of the recently devised BulletButton® device. For example, the AR-15 (aka: M16) rifle was originally designed and manufactured as a fully-automatic firing gun, however some State-governments (such as California, requiring a separate tool-release of a maximum 10-round magazine-clip) impose modifications mandating conversion-restriction into only semi-automatic operation; which resulting ergonomic encumbrance to the users of these guns during firing-range practice, is said to unwittingly pose a handling awkwardness which some regard as adversely imperiling the safe operation of the gun, by distracting the shooter's attention from down-range concentration. This detrimental effect occurs when the shooter has spent the last round of their gun's magazine-clip, and is thus caused to fumble for a separate pocket-tool (—such as the head of a .223-cal. bullet), which is necessarily inserted into the nominally ⅛th-inch diameter release-hole provided in the State-mandated so-called "BulletButton®",—so a to thereby facilitate a linear depression actuation of a sub-button recessed therein. This intentionally impeding release-button device (—presently mfg. by Darin L. Prince of Bonsall, Calif. USA), as well as the similar RaddLock™ button-device, actually retrofitively replace the original quick-action magazine-clip release-button (—having no center-bore sub-button) located upon the right-sidewall of the gun's breech. In 1989 the Roberti-Roos Assault-weapons Control-act was passed [—as Calif./Penal-code §12276.1(a.)], mandating the encumbering of the original quick-release button be retrofitted into what is legislatively referred to as a 'fixed-magazine' release-button, necessitating the use of an encumbering supplemental-tool which by legislative mandate cannot be an inherently permanent part of the rifle.

B.) Accordingly, the object of this invention disclosure is to set forth my basic M1/SRT (supplemental-release tool) rifle ammunition magazine-clip button-depressor MagMagnet™ (ie:—an amalgamation of the terms 'magazine' and 'magnet'). Whereas my initial preferred embodiment employs an index-finger finger-stall (aka: cot or sheath) member which car be made of a rigid plastic or metal, but more preferably made of a relatively flexile material such as latex-rubber or resilient urethane elastomer, or even a glove material such as canvas or leather;—in any case, to be adapted with a tiny rigid probe insertion-pin approximately only ¼-inch long and approximately ⅛-inch in diameter. In any case, the insertion-pin thereof is thus necessarily made to be a 'slip-fit' into the center-bore of the existing specialty impeding release-button (aka: BulletButton®) device, and of a length as to become readily inserted to sufficient depth as to thus depress the secondary/inset-sub-button therein, as to thereby attain ultimate release of the magazine-clip. Moreover, owing that the impeding release-button is located upon the right sidewall of the AR-15's breech (ie:—the main-housing into which the magazine-clip is inserted), there are necessarily two finger-tip positions for the insertion-pin extending dependently from the finger-stall;—the position-R which is aligned substantially coaxial with the longitudinal-axis of the shooter's index-finger being for right-handed users;—and position-L arranged at a substantially acute-angle to the longitudinal-axis of the index-finger, being for left-handed users. And while two different finger-stalls may be offered (one for the right-handed, and another for the left-handed shooter), for general inventory convenience it is preferred that one universal finger-stall be adapted with the two optional positions, simply by virtue of a male/screw-threaded insertion-pin which can be interchangeably secured into either of the two optional female/screw-threaded anchor-receptacle positioning holes provided proximal the tip of the finger-stall appliance. Additionally, the insertion-pin may be made with a magnetic material such as a neodymium rare-earth permanent-magnet; which would have the effect of helping to draw the insertion-pin into the center-bore of the impeding release-button (BulletButton®) while the shooter is operating the gun during target-practice. Yet conversely, once the expended magazine-clip becomes released by action of the insertion-pin, desired withdrawal of the magnetized insertion-pin would merely involve one's pulling their index-finger away from presense within the center-bore of the impeding release-button, insert a loaded magazine-clip, and then merely shifting their index-finger back within the trigger-guard so as to commence firing at a down-range target.

C.) A further object of this invention disclosure is to set forth an alternate self-sustaining iteration in form of a generic-variant embodiment of my finger worn supplemental rifle ammunition magazine-clip button-depressor releasing tool described in preceding item-B, wherein this non-finger worn version is designated my M2/SRT (supplemental-release tool) also generally referred to as the MagMagnet™, but described as employing a similar approximately. ⅛-inch diameter cylindrical preferably neodymium permanent-magnet insertion-pin, however adapted in its simplest iteration with merely an integral disk-like head portion serving as a comfortable finger-contact surface. Additionally, this head portion can be configured with a somewhat intimately fitting apron surround, serving as somewhat of a dust-shield substantially enshrouding the impeding release-button (BulletButton® member,—which is permanently installed into the gun's breech side-wall);—and in which, case the cylindrical magnetic insertion-pin can either be press-fitted or chemically-bonded into a receiver-boss formed upon the normally unseen underside of the finger-contact head (or may be screw-threaded into the receiver-boss).

III.) DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the claims section annexed hereto; and accordingly, a better understanding of the invention and the variant uses is intended, by reference to the drawings, which are considered as primarily exemplary and not to be therefore construed as restrictive in nature; wherein:

FIG. 1, is a pictorial perspective-view, favoring the frontal lower-right aspect of an AR-15 rifle depicted engaged in target shooting; and in particularly is showing the usual poising of the shooter's index-finger relative to both the trigger-guard along reference-line A':A" and the magazine-clip release-button along reference-line B':B";

FIG. 2A, is a greatly enlarged diagrammatic detail cross-sectional upper/plan-view taken along reference-plane A':A" indicated in FIG. 1, thus looking down at the right sidewall of the AR-15's rifle's breech, and serves to simplistically if clearly reveal the rudimentary construction of magazine-clip's subject IRB (impeding release-button) while indicating via action/reference-arrow "X" that actuation via use of one's index-finger alone is intentionally immobilized (prevented);

IV.) ITEMIZED NOMENCLATURE REFERENCES

Figure 1:
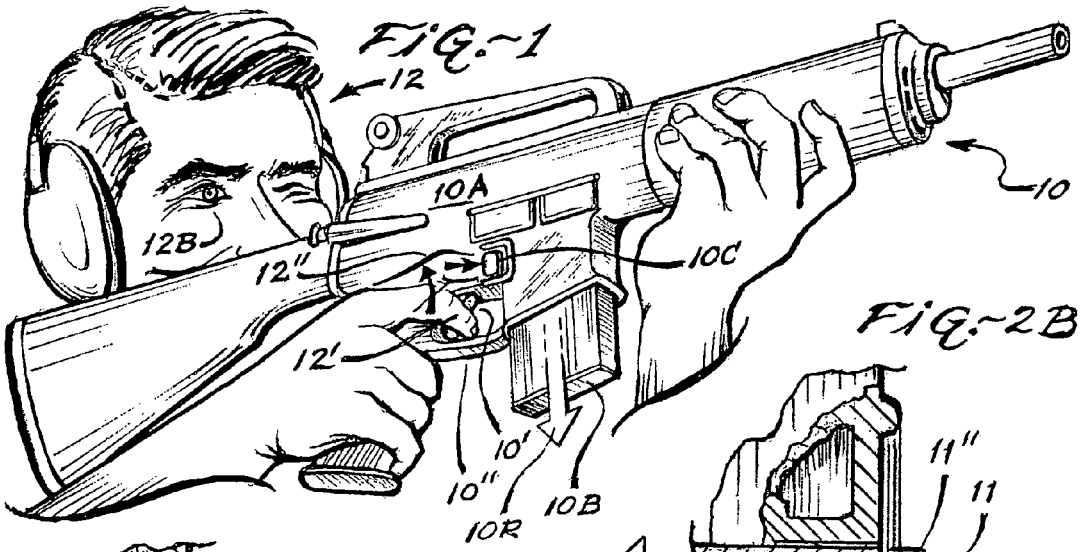

10,10',10",10A,10B,10C,10R—AR-15 rifle, trigger, trigger-guard, breech, magazine-clip, orig. release-button, downward release action (ref.-arrow)

11,11',11",11A,11B—impeding release-button, center-bore, sub-button, return-spring, bullet-tip

12,12'/12",12A,12B—shooter, index-finger: on-trigger/on-button, outer-finger, finger longitudinal-axis, sighting-eye

13,13',13",13S—finger-stall, longitudinal ref.-axis/acute-angle ref.-axis, sheath

14,14'/14",14H,14L,14N—transverse-strap, loop portion/hook portion, relief-hole, lateral-reliefs, occluded nose

15,15'/15"—female/screw-threads, anchoring-receptacle: right-hand/left-hand

16,16'/16",16A,16S,16P,16M—insertion-pin, first terminus/second terminus, elongate-axis, male/screw-threads, Phillips-head x-slot, magnetic body (generic-variant)

17,17',17"—annular-flange head, receiver-boss, perimeter-wall apron

V.) DETAILED DESCRIPTION OF THE PREFERRED EMBODIMENTS

Figure 2B:
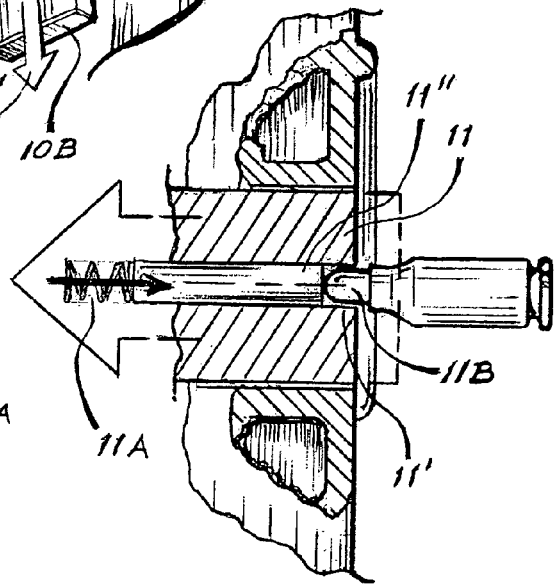
FIG. 2B, is a companion sequence thereof, still depicting the prior-art A':A" viewing aspect while revealing how actuation of the subject IRB (impeding release-button) was heretofore achieved via cumbersome use of a hand-held auxiliary-implement such as the depicted use of the tip of a bullet.
Figure 2A:
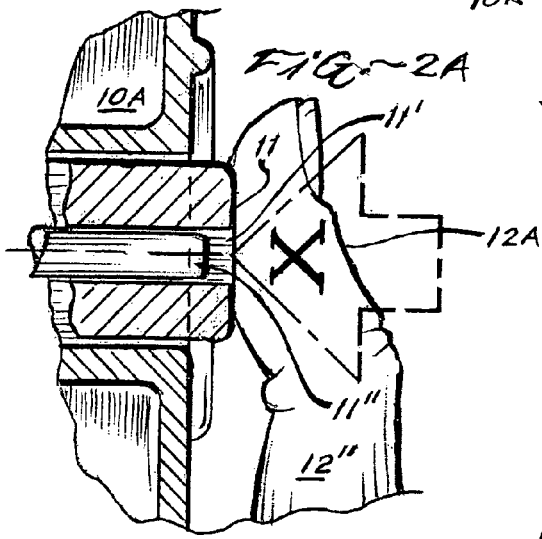

Initial reference is given by way of FIG. 1, wherein is exemplified a typical target-shooting stance for the AR-15 rifle 10, wherein the shooter's eye 12B is trained upon a distant unshown target, while their index-finger 12' is inserted within the gun's trigger-guard 10" poised upon the trigger 10' while thus firing in the index-finger's 1st-position. Once the ammunition within 10-round magazine-clip 10B is expended, the shooter 12 would merely remove their index-finger 12' from within the trigger-guard 10" and then momentarily shift their index-finger to a 2nd-position 12" so as to depress the magazine-clip 10B release button 10C. However, in certain States where civilian-owned automatic-firing action is outlawed, the simple original magazine-clip release-button 10C of FIG. 1 is necessarily retrofitably modified via a special recently introduced IRB (impeding release-button) 11 commercially referred to as the BulletButton® initially shown in FIG. 2A, which existing device includes a center-bore 11' having an approximately ⅛-inch inset secondary sub-button 11", thus requiring insertion of a makeshift hand-tool, which heretofore generally being simply the tip 11B portion of a bullet (such as an ordinary .223-caliber), which has been until now substituting as an improvised tool of sorts. Accordingly, while FIG. 2A serves to demonstrate that the IRB (impeding release-button) 11 cannot be willfully depressed owing that the very small recessed sub-button 11" cannot be accessed by one's finger 12', FIG. 2B goes on to graphically demonstrate just how the improvised bullet-tip 11B is manually inserted as to awkwardly achieve release of the magazine-clip 10C (shown being ejected 10R in FIG. 1).

Figure 3A:
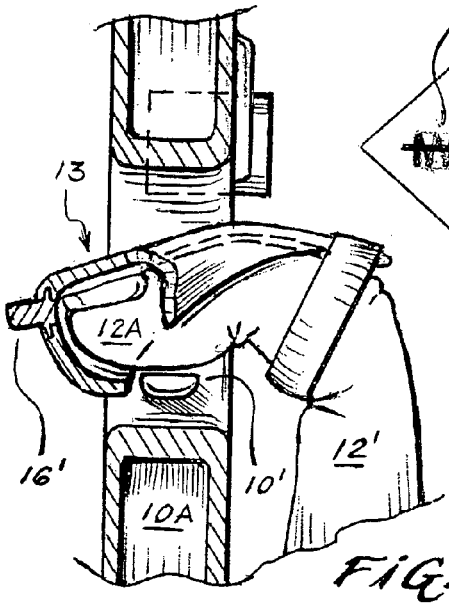
FIG. 3A, is a further viewing sequence taken along reference-plane B':B" of FIG. 1, whereto is revealed how my specialized novel finger-tip supported M1/SRT (supplemental-release tool) is poised within the trigger-guard and upon the gun's trigger during normal firing of the gun.
Figure 3B:
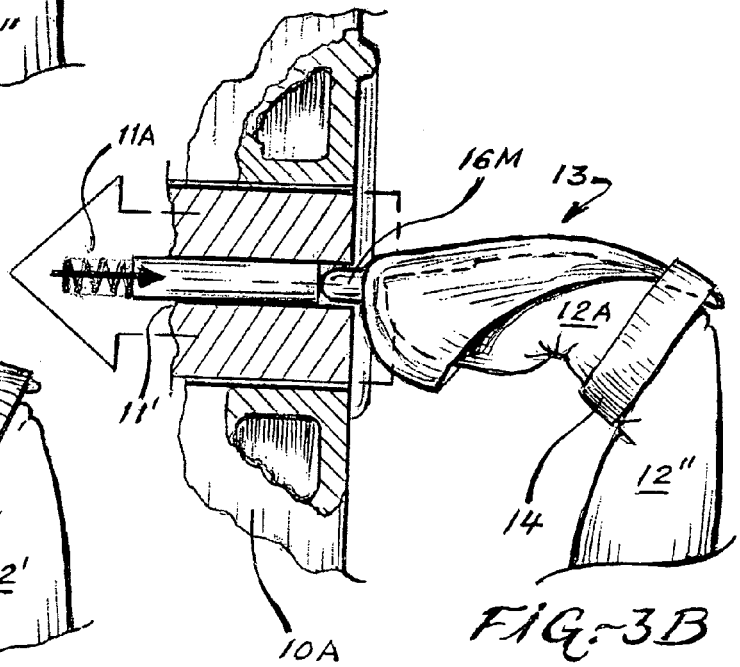
FIG. 3B, is a companion sequence to that of FIG. 3A, but wherein the viewing aspect is taken along reference-plane A':A" in FIG. 1, and is depicting the shooter's index-finger having been shifted from region of the trigger-guard to placement of my novel M1/SRT device upon the IRB ('impeding release-button), revealing as a motion-study how depression of the IRB is in effect now smoothly achieved.

Reference to FIG. 3A shows how easily the shooter's index-finger 12' poised upon trigger 10' is accommodated within the trigger-guard opening, although shown supporting my M1/SRT finger-stall 13 appliance which is adapted with integral insertion-pin 16 (right-hand version shown) having elongate-axis 16A and first terminus 16' for probing insertion, and second terminus 16" for permanent anchoring as is suggested in FIGS. 3A & 3B.

Figures 3C, 4A, 4B, 4C, 4D:
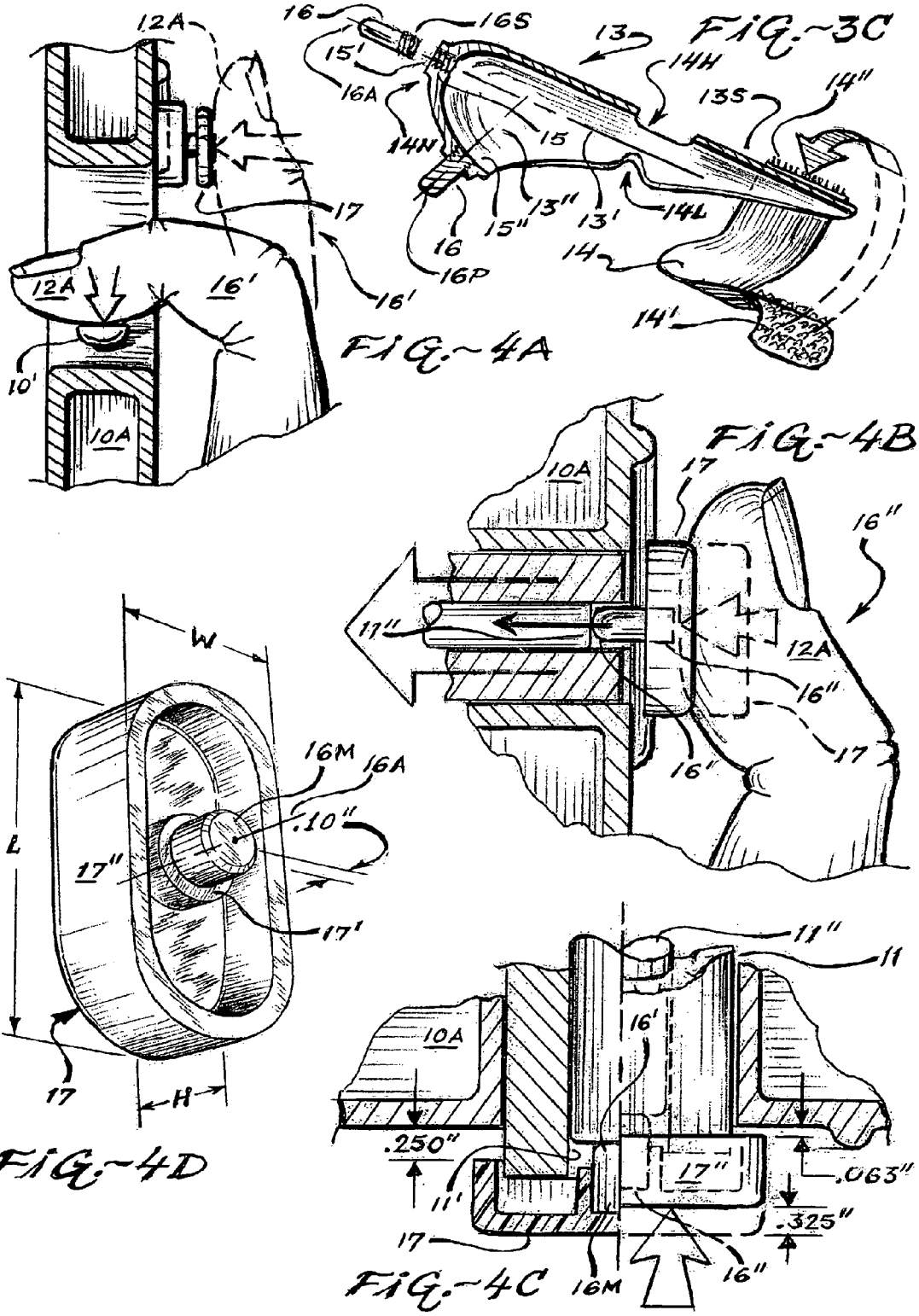
FIG. 3C, is a cross-sectional side/elevation-view of my M1/SRT embodiment, showing further features including the relative orientations of the optional anchoring-receptacles.
FIG. 4A, is a further sequence taken along reference-plane B':B" of FIG. 1, and whereto is now initially revealed how when using my alternate specialized novel M2/SRT embodiment, the shooter's index-finger is freely poised upon the trigger within the trigger-guard during normal firing of the gun.
FIG. 4B, is a companion sequence to that of FIG. 4A, but wherein the viewing aspect is taken along reference-plane A':A" in FIG. 1, and is depicting the shooter's index-finger having been shifted from region of the trigger-guard to placement upon my M2/SRT device shown having been already lodged in a self-sustaining manner upon the IRB, whereby smooth actuation is thus achieved.
FIG. 4C, is a partial cross-sectional plan-view of my self-retaining M2/SRT embodiment, wherein the deluxe version with the perimeter apron is shown in static-position the left-half, but in fully-depressed dynamic-position at the right-half of the illustration.
FIG. 4D, is an oblique view showing the underside of my M2/SRT embodiment, revealing the general preferred configuration.

In FIG. 3B the partial sheath 13S portion of my finger-stall 13 which extends aftwardly over the outside of shooter's index-finger 12' is preferably also formed with a flexion relief-hole 14H, while in FIG. 3C a pair of additional lateral (right & left) flexion-reliefs 14L are also preferred. The forward nose of my finger-stall is preferably formed occluded 14N, so as to better facilitate considerable exertion of physical pressure at one's finger-tip; plus the entire assembly is preferably held fast to the shooter's index-finger by use of an encircling transverse-strap 14 which may include readily avulsable Velcro® type usual loop 14'L and hook 14" portions. Because of this preferred universal (Rt. & Lt. accommodations) configuration, the FIG. 3C embodiment shows my ambidextrous version offering two optional insertion-pin 16 installation positions 15' and 15", which remain satisfactorily stabilized regardless as to the position selected; thereby universally accommodating either left or right handed shooters relative to actuation of the existing right-sided IRM-button 11. Accordingly, a single insertion-pin 16 can be interchangeably secured in place via removable means, such as by male/screw-threads 16S mating into female/screw-threads 15. Moreover, the outer first terminus 16' of insertion-pin 16 may be adapted with provision of an X-slot 16P enabling use of a small conventional Phillips-head screwdriver for convenient repositioning and securing of insertion-pin 15 for either left or right handed shooters (—naturally alternative wrenching means such as a conventional Allen-head socket may be elected as an equivalent engineering-design choice).

While my finger-stall embodiments may be made of a flexile material such as molded urethane-resin, it may also be made of a relatively rigid material such as resilient molded polycarbonate plastic or a malleable metal such as aluminum;—and preferably includes a convenient transverse Velcro® retention-strap 14 which loop-portion 14' is permanently secured at its mooring-end, whereby it is passed beneath index-finger 12' and thereby avulsibly secured at its outer-end to fixed hook-portion 134". As a further assist to the shooter, it is intended that a substantially identical appearing optional magnetic insertion-pin 16M may be included, and it is preferably made from powerful rare-earth magnetic material 'neodymium', which is metal-like in appearance, and as such serves to thus aid landing of the insertion-pin into the center-bore 11' as to ultimately impinge upon sub-button 11".

There remain subtle, however vital other differences which are to become herein more evident and understood as important improvements. For example, FIG. 4A shows a further iteration of my invention which is self-sustaining in place by virtue of employing only the magnetic type insertion-pin 16M, whereas the device is thus manually inserted into the center-bore 11' of the same impeding release-button 11, as to thereby intimately engage upon sub-button 11". Note here, that index-finger 12' is poised freely upon trigger 10' without aid of the finger-stall, yet the overall function is substantially as with my preceding finger-stall version, excepting that in the case of this self-retaining embodiment insertion is initially achieved whilst momentarily holding the disk-like annular-flange 17 head portion between one's thumb and forefinger;—at which point the fingers are to be entirely released once the slip-fitting insertion-pin portion 16' is magnetically attracted into center-bore 11", and thus snaps into impingement with an audible 'click' upon insertion. Therefore, owing its constant magnetic attraction, this version of my finger-tip supplemental-release insertion-pin device generally remains impinged with the sub-button 11", even once the magazine-clip 10*b* downward-release (ref. arrow 10R) is accomplished, the shooter's finger can be immediately shifted back from position 12" to position 12' within trigger-guard 10";—the shooter 12 only necessarily shifting their right or left hand index-finger from its 1st-position 12' proximal the trigger-guard 10" to its 2nd-position 12", as eluded to in FIG. 1. In FIG. 4C is shown a deluxe generic-variant of this self-retaining version, wherein is included a perimeter-wall apron portion 17" which addition lends in effect a cupped underside configuration serving as somewhat of a dust-shield provision. This more elaborate cupped embodiment is further shown in FIG. 4D, wherein the approximate overall dimensions are: 21 mm-long (L), 13 mm-wide (W), 9 mm-height (H); plus the magnetic insertion-pin 16M extends beyond the base of the apron by only about 1 mm.

Thus, it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

The invention claimed is:

1. A magazine-clip release tool for a gun fitted with an impediment type release button, the magazine-clip release tool comprising:

a flange head having a first side and a second side;

a perimeter wall connected to the edge of the flange head and extending from the first side of the flange head in a direction parallel to an axis oriented normal to the flange head;

a receiver connected to the first side of the flange head and extending from the first side of the flange head along the axis of the flange head within the perimeter wall and terminating at a point below the height of the perimeter wall, the receiver having a circular-shaped outside surface having a diameter dimensioned to fit inside a circular-shaped release hole of an impediment type release button; and an insertion pin having an elongate axis disposed in parallel to the axis of the flange head, the insertion pin having an opposed first terminus end and a second terminus end, the second terminus end disposed in the receiver and the first terminus end extending from the receiver such that the first terminus end of the insertion pin extends out of the receiver.

2. The magazine-clip release tool of claim 1, wherein the first terminus end of the insertion pin extends out of the receiver to a position below the height of the perimeter wall.

3. The magazine-clip release tool of claim 2, wherein the first terminus end of the insertion pin extends out of the receiver to a position about 1 mm below the perimeter wall.

4. The magazine-clip release tool of claim 1, wherein the first terminus end of the insertion pin extends out of the receiver to a position about 1 mm beyond the perimeter wall.

5. The magazine-clip release tool of claim 1, wherein the insertion pin comprises a magnetic material.

6. The magazine-clip release tool of claim 5, wherein the magnetic material comprises a rare-earth neodymium type.

7. The magazine-clip release tool of claim 1, wherein the diameter of the insertion pin is approximately ⅛".

8. The magazine-clip release tool of claim 1, wherein the perimeter wall is spaced apart from the receiver to allow the release tool to enshroud the impediment type release button.

9. The magazine-clip release tool of claim 1, wherein the perimeter wall is oval-shaped.

10. A magazine-clip release tool for a gun fitted with an impediment type release button, the magazine-clip release tool comprising:

a flange head having a first side and a second side;

a receiver connected to the first side of the flange head and extending from the first side of the flange head along the axis of the flange head, the receiver having a circular-shaped outside surface having a diameter dimensioned to fit inside a circular-shaped release hole of an impediment type release button; and a magnetic insertion pin having an elongate axis disposed in parallel to the axis of the flange head, the insertion pin having an opposed first terminus end and a second terminus end, the second terminus end disposed in the receiver and the first terminus end extending from the receiver such that the first terminus end of the insertion pin extends out of the receiver, the magnetic insertion pin dimensioned to magnetically connect to a magazine release sub-button recessed in the release hole of an impediment type release button.

* * * * *